US007184016B2

(12) United States Patent
Bu et al.

(10) Patent No.: US 7,184,016 B2
(45) Date of Patent: Feb. 27, 2007

(54) DATA DRIVER FOR AN LCD PANEL

(75) Inventors: Lin-Kai Bu, Shanhua Township, Tainan County (TW); Chuan-Cheng Hsiao, Shanhua Township, Tainan County (TW); Yen-Chen Chen, Shanhua Township, Tainan County (TW)

(73) Assignee: Himax Technologies Limited, Tainan County (TW)

( * ) Notice: Subject to any disclaimer, the term of this patent is extended or adjusted under 35 U.S.C. 154(b) by 541 days.

(21) Appl. No.: 10/668,983

(22) Filed: Sep. 22, 2003

(65) Prior Publication Data

US 2004/0155849 A1 Aug. 12, 2004

(30) Foreign Application Priority Data

Feb. 10, 2003 (TW) ..... 92102692 A

(51) Int. Cl.
*G09G 3/36* (2006.01)

(52) U.S. Cl. ..... 345/100; 345/98; 345/204; 345/211; 345/212; 345/213; 345/690

(58) Field of Classification Search ..... 345/100, 345/98, 204, 211–213, 690
See application file for complete search history.

(56) References Cited

U.S. PATENT DOCUMENTS 7,015,889 B2 * 3/2006 Ahn et al. ..... 345/98
2001/0043187 A1 11/2001 Ikeda ..... 345/100
2003/0146909 A1 * 8/2003 Maki ..... 345/204

FOREIGN PATENT DOCUMENTS

JP 11-167373 * 6/1999

* cited by examiner

*Primary Examiner*—Richard Hjerpe
*Assistant Examiner*—Leonid Shapiro
(74) *Attorney, Agent, or Firm*—Thomas, Kayden, Horstemeyer & Risley

(57) ABSTRACT

A data driver for driving multiple data lines on an LCD panel according to multiple channels of pixel data. In the data driver, a digital buffer receives and stores the pixel data at several times and selectively outputs a channel of the pixel data at a time. A DAC receives the pixel data output from the digital buffer at several times, converts the pixel data into multiple channels of analog pixel data and outputs the analog pixel data at several times. An analog buffer receives the analog pixel data output from the DAC at several times and outputs the analog pixel data at a time. An output buffer receives the analog pixel data output from the analog buffer so as to drive the data lines.

9 Claims, 7 Drawing Sheets

DATA DRIVER FOR AN LCD PANEL

This application claims the benefits of Taiwan application Serial No. 92102692, filed Feb. 10, 2003.

BACKGROUND OF THE INVENTION

1. Field of the Invention

The invention relates to a data driver for an LCD (Liquid Crystal Display) panel, and more particularly to a data driver capable of saving the number of DACs (digital-to-analog converters).

2. Description of the Related Art

Recently, LCDs have been widely used because they have favorable advantages of thinness, lightness and low electromagnetic radiation. It is therefore an important subject in the LCD field to decrease the costs of the LCDs and to increase the product competitiveness.

FIG. 1 is an architecture diagram showing a conventional LCD system. The LCD panel 100 with a resolution of 1024×768 will be described as an example. The LCD panel 100 has 1024×3 data lines that are respectively driven by data drivers 102, and 768 scan lines that are respectively driven by scan drivers 104. If each data driver 102 may drive 384 data lines and each scan driver 104 may drive 256 data lines, the LCD panel 100 requires eight data drivers 102 and three scan drivers 104. The data drivers 102-1 to 102-8 sequentially receive multiple channels of pixel data PD from a controller 106 under the control of a data control signal Cntl_D output from the controller 106. The data drivers 102-1 to 102-8 process the received pixel data PD and then drive multiple data lines of the LCD panel 100. On the other hand, the scan drivers 104 sequentially output scan signals to scan each scan line under the control of a scan control signal Cntl_S output from the controller 106.

FIG. 2 is a circuit block diagram showing the data drivers 102-1 to 102-8 of FIG. 1. The conventional data driver 102 is composed of a shift register 212, a first line buffer 214A, a second line buffer 214B, a digital-to-analog converting circuit 216, and an output buffer 218. The shift register 212 outputs a control signal C. The first line buffer 214A sequentially receives and stores the pixel data PD output from the controller 106 according to the control signal C. After the first line buffer 214A finishes its receiving operations, the first line buffer 214A simultaneously transfers all the pixel data PD stored therein to the second line buffer 214B. The second line buffer 214B simultaneously outputs all the pixel data PD to the digital-to-analog converting circuit 216. The output buffer 218 parallely receives the pixel data PD output from the digital-to-analog converting circuit 216 and also parallely outputs the pixel data PD to the data lines of the LCD panel 100.

The operations of the data drivers 102-1 to 102-8 as shown in FIG. 2 will be further described with reference to an example of the data driver 102-1. It is assumed that the controller 106 outputs two ports of pixel data PD to the line buffer 214-1 at a time, wherein each port of pixel data includes a channel of red pixel data, a channel of blue pixel data, and a channel of green pixel data. That is, the controller 106 outputs six channels of pixel data PD to the line buffer 214-1 at a time. If each channel of pixel data has 8 bits, each of the first line buffer 214A and the second line buffer 214B must have 384×8 bits (i.e., 6×64×8 bits) because the data driver 102-1 has to drive 384 data lines. The controller 106 has to output 6×8 bits of six channels of pixel data at a time. After 64 times of outputs, the pixel data input operations for one data driver 102-1 are completed. After the pixel data receiving operations for one data driver 102 are finished, the pixel data receiving operations for another data driver 102 are started.

After the pixel data receiving operations for the first line buffer 214A-1 are finished, the first line buffer 214A-1 parallely and simultaneously transfers the stored 6×64×8 bits of pixel data PD to the second line buffer 214B-1. Then, the second line buffer 214B-1 simultaneously outputs the pixel data PD to the digital-to-analog converting circuit 216-1. The digital-to-analog converting circuit 216-1 includes 384 DACs (digital-to-analog converters), that is, DAC(1) to DAC(384). Each DAC may convert one channel of pixel data PD. Thus, the digital-to-analog converting circuit 216-1 may simultaneously convert 384 channels (i.e., 6×64×8 bits) of pixel data PD into analog data.

After the digital-to-analog converting circuit 216-1 simultaneously converts the 6×64×8 bits of pixel data PD into the analog data, the digital-to-analog converting circuit 216-1 simultaneously and parallely inputs the 384 channels of analog pixel data PD to the output buffer 218-1. The output buffer 218-1 is composed of multiple OP amplifiers, which may enhance the capability of the 384 channels of analog pixel data PD output from the data driver 102-1 for driving the data lines.

In a general circuit layout, the DACs occupy relatively large area. In each of the conventional data driver 102, because 384 channels of data pixel PD have to be converted into analog data, 384 DACs are required. Consequently, the chip area of the overall data drivers 102 is relatively large and the cost thereof is relatively high. Therefore, it is very important to reduce the area required by the DACs and to reduce the cost.

SUMMARY OF THE INVENTION

It is therefore an objective of the invention to provide a data driver capable of effectively reducing the chip area occupied by the DAC and thus the cost.

The invention achieves the above-identified objective by providing a data driver for driving multiple data lines on an LCD panel according to multiple channels of pixel data. The data driver includes a digital buffer, a DAC, an analog buffer, and an output buffer. The digital buffer receives and stores the pixel data at several times and selectively outputs a channel of the pixel data at a time. The DAC receives the pixel data output from the digital buffer at several times, converts the pixel data into multiple channels of analog pixel data and outputs the analog pixel data at several times. The analog buffer receives the analog pixel data output from the DAC at several times and outputs the analog pixel data at a time. The output buffer receives the analog pixel data output from the analog buffer so as to drive the data lines.

The invention also achieves the above-identified objective by providing a data driver for driving multiple data lines on an LCD panel according to multiple channels of pixel data. The data driver includes a digital buffer, N sets of DACs, an analog buffer, and an output buffer. The digital buffer receives and stores the pixel data at several times and selectively outputting N channels of the pixel data at a time, wherein N is a positive integer greater than 1 and smaller than the number of the data lines. The DACs receive the pixel data output from the digital buffer, simultaneously convert N channels of the pixel data into N channel of analog pixel data, and output the analog pixel data. The analog buffer receives the analog pixel data output from the DACs at several times and outputs the analog pixel data at a time. The output buffer receives the analog pixel data output from the analog buffer so as to drive the data lines.

Other objects, features, and advantages of the invention will become apparent from the following detailed description of the preferred but non-limiting embodiments. The following description is made with reference to the accompanying drawings.

DETAILED DESCRIPTION OF THE INVENTION

The spirit of the invention resides in that one or multiple DACs are utilized in each data driver and one or multiple channels of pixel data are input to the DACs at a time for digital-to-analog conversion, thereby saving the chip area of the data driver.

Figures 3, 3A, 3B:
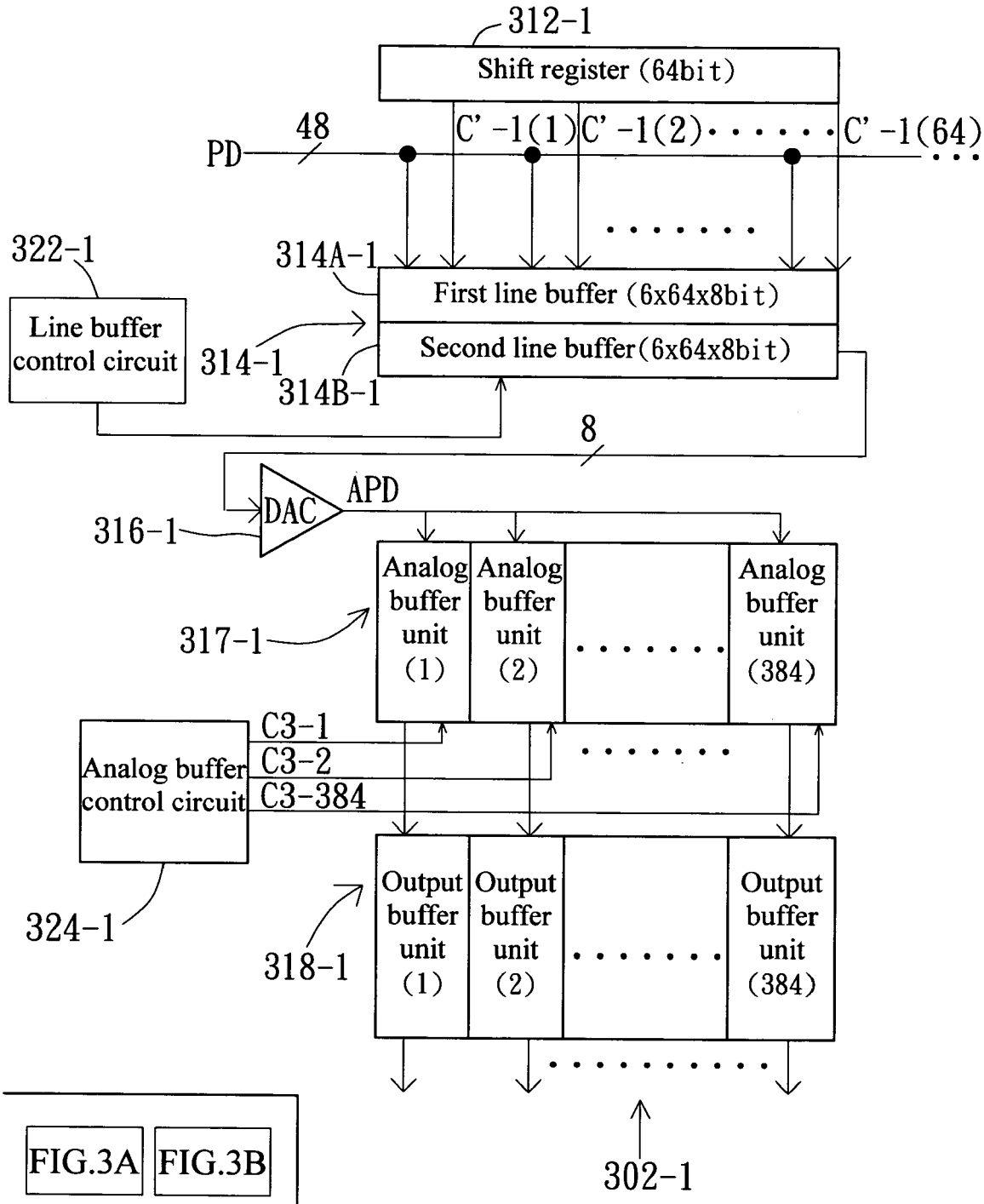
FIG. 3 is a circuit block diagram showing multiple data drivers according to a first embodiment of the invention.
Figure 3B:
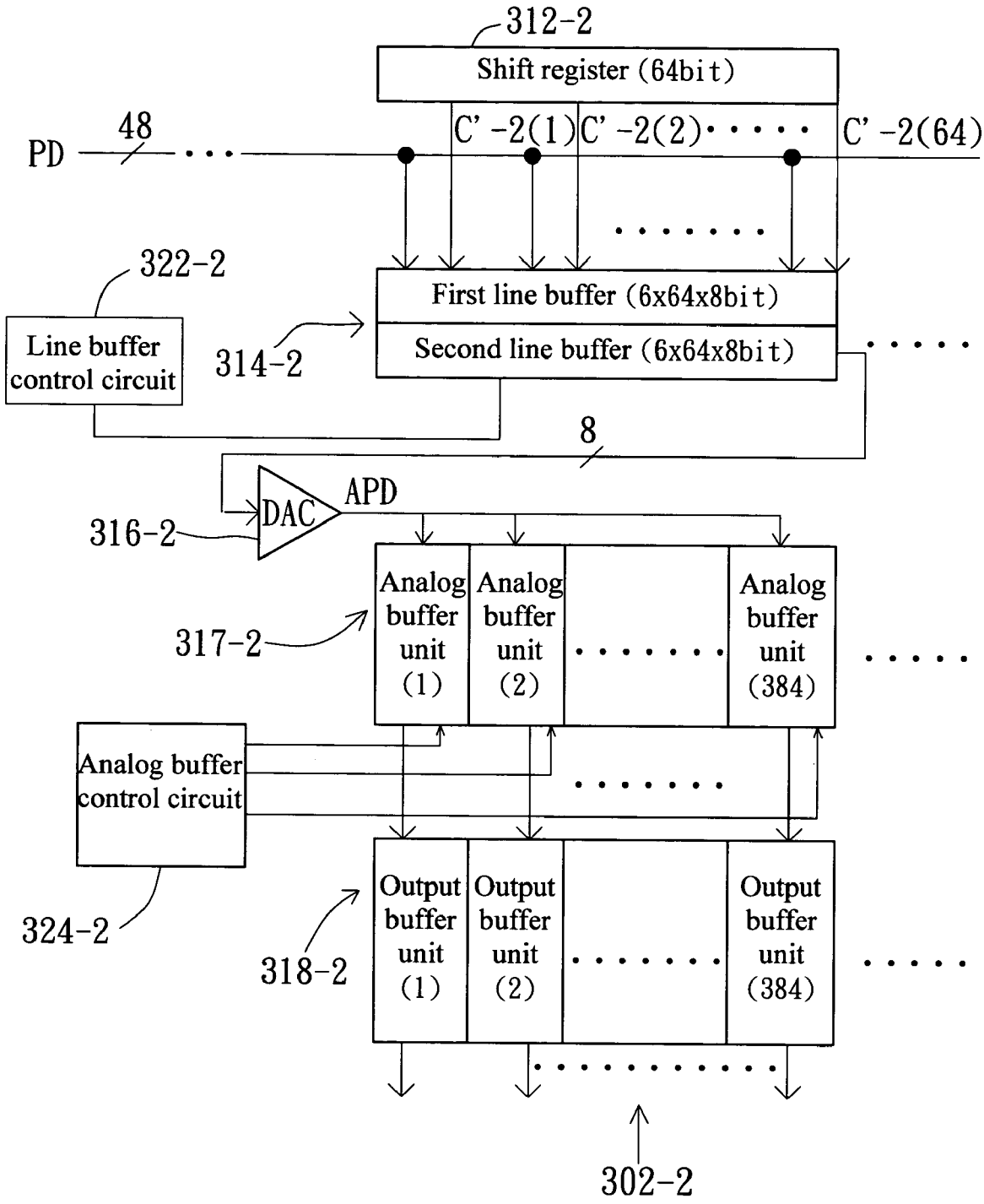

FIG. 3 is a circuit block diagram showing multiple data drivers according to a first embodiment of the invention. An LCD panel requires multiple data drivers to drive data lines. As shown in FIG. 3, eight data drivers are disclosed as an example. Each data driver 302 includes a shift register 312, a digital buffer 314, a DAC (digital-to-analog converter) 316, an analog buffer 317, and an output buffer 318. The shift register 312 outputs a first control signal C' to the digital buffer 314. The digital buffer 314 sequentially receives and stores the pixel data PD according to the first control signal C'. The digital buffer 314 selectively outputs the pixel data PD at several times. The digital buffer 314 outputs a channel of pixel data PD to the DAC 316 at a time. The DAC 316 receives the pixel data PD output from the digital buffer 314 and then converts the pixel data PD into analog pixel data APD. The analog buffer 317 receives and stores the analog pixel data APD output from the DAC 316 and then outputs the stored analog pixel data APD at a time. The output buffer 318 receives the analog pixel data APD output from the analog buffer 317 so as to drive the data lines.

The digital buffer 314 may be composed of a first line buffer 314A and a second line buffer 314B. The first line buffer 314A sequentially receives and stores the pixel data PD according to the control signal C'. After the first line buffer 314A finishes its receiving operations, the first line buffer 314A parallely and simultaneously transfers the pixel data PD of the first line buffer 314A to the second line buffer 314B.

The data driver 302 of the invention further includes a line buffer control circuit 322. The second line buffer 314B is composed of multiple line buffer units (not shown). The line buffer control circuit 322 outputs a second control signal C2 to the second line buffer 314B. The second line buffer 314B selectively outputs a channel of pixel data PD at a time under the control of the line buffer control circuit 322. That is, the second control signal C2 selects one line buffer unit at a time and the second line buffer 314B outputs the pixel data PD stored in the selected line buffer unit.

For example, each line buffer unit may be composed of a latch and a switch. The latch stores the pixel data PD and the switch turns on or off under the control of the second control signal C2. The way for selectively outputting the pixel data may includes a step of, for example, turning on the switch of the selected line buffer unit according to the second control signal C2 in order to output the pixel data PD stored in the latch of the selected line buffer unit.

The DAC 316 converts a channel of pixel data PD into analog data at a time and also outputs a channel of analog pixel data APD at a time.

In addition, the analog buffer 317 may be composed of multiple analog buffer units that include analog buffer units (1) to (384). Each analog buffer unit may be implemented by a sample and hold circuit. An analog buffer control circuit 324 controls the analog buffer 317 and outputs third control signals C3 to control the analog buffer 317. The third control signals include signals C3-1 to C3-384 for controlling the analog buffer units (1) to (384), respectively. The analog buffer units sequentially receive the analog pixel data APD output from the DAC 316 under the control of the third control signals C3. A channel of the analog pixel data APD output from the DAC 316 is stored in the analog buffer units (1) to (384) at a time. After the analog buffer 317 finishes its receiving operations, the analog buffer 317 parallely and simultaneously outputs the analog pixel data APD to the output buffer 318.

The third control signals C3 output from the analog buffer control circuit 324 may control the analog buffer 317 in the following manners. The third control signals C3 may select an analog buffer unit, which is to be electrically connected to the DAC 316, to receive the analog pixel data APD output from the DAC 316. The third control signals C3 may also control the analog buffer unit to output the analog pixel data APD at a predetermined time point. For example, the third control signals C3 may control the analog buffer units (1) to (384) to simultaneously output 384 channels of analog pixel data APD to the output buffer 318 after 384 channels of analog pixel data APD are received.

The operations of the data driver 302 as shown in FIG. 3 will be further described in the following. Since the operations of the data driver 302-1 to 302-8 are substantially the same, only the data driver 302-1 is described as an example.

It is assumed that the first line buffer 314A-1 receives two ports of pixel data PD (i.e., six channels of pixel data including two channels of red pixel data, two channels of blue pixel data, and two channels of green pixel data) at a time. If each channel of pixel data PD has 8 bits, the first line buffer 314A-1 receives 48 (=6×8) bits of pixel data PD at each time. By enabling one of the 64 bits in the shift register 312-1 (i.e., by enabling one of the control signals C'-1(1) to C'-1(64)), it is possible to select different storage addresses of the first line buffer 314A-1 and to store the received pixel data PD in a corresponding storage address in the first line buffer 314A-1. Therefore, the 384 channels of pixel data PD can be completely received after the first line buffer 314A-1 has received the data at 64 times, wherein the first line buffer 314A-1 may have a capacity of 6×64×8 bits.

After the first line buffer 314A-1 finishes its receiving operations, all the pixel data PD stored in the first line buffer 314A-1 are parallely and simultaneously transferred to the second line buffer 314B-1, wherein the second line buffer 314B-1 may also have a capacity of 6×64×8 bits.

After the second line buffer 314B-1 completely receives the pixel data PD stored in the first line buffer 314A-1, the second line buffer 314B-1 selectively outputs a channel of pixel data PD to the DAC 316-1 at a time under the control of the line buffer control circuit 322-1, thereby converting the pixel data PD into analog data. The second line buffer 314B-1 may have, for example, 384 line buffer units, which are assumed to be selected from left to right to output the digital pixel data PD stored therein. The DAC 316-1 performs 384 times of digital-to-analog conversion in order to completely convert 384 channels of digital pixel data PD stored in the second line buffer 314B-1.

That is, the line buffer control circuit 322-1 controls the second line buffer 314B-1 to output a channel of stored pixel data PD one by one, the DAC 316-1 receives a channel of pixel data PD one by one, and a channel of pixel data PD are converted into analog data at a time. Therefore, the second line buffer 314B-1 has to output the pixel data PD at 384 times, and the digital-to-analog converting circuit 316-1 has to perform 384 times of digital-to-analog conversion in order to completely convert 384 channels of pixel data PD stored in the second line buffer 314B-1. The converted analog pixel data APD is sequentially stored, one channel at a time, in the analog buffer units (1) to (384) of the analog buffer 317-1 under the control of the control signal C3 output from the analog buffer control circuit 324-1.

Then, after 384 channels of analog pixel data APD are completely stored in the analog buffer 317-1, the analog buffer 317-1 outputs the 384 channels of analog pixel data APD to the output buffer 318-1 under the control of the control signal C3 output from the analog buffer control circuit 324-1. The analog pixel data APD passes through 384 output buffer units (1) to (384) such as 384 OP amplifiers in the output buffer 318-1. The output buffer units (1) to (384) are electrically connected to the data lines, respectively.

The upper limit of the conversion time for the digital-to-analog conversion in the digital-to-analog converting circuit 316 of this embodiment may be up to 1/384 of scanning time. The so-called scanning time means the image display time for one row of pixels corresponding to one scan line, and substantially equals to the display time for one frame of the LCD divided by the number of scan lines. When the data pixel PD is input to the first line buffer 314A, 3092 (=384×8) channels of pixel data PD has to be sequentially input to the first line buffers 314A-1 to 314A-8 within a period of scanning time. However, since each second line buffer 314B only has to output 384 channels of pixel data within a period of scanning time (i.e., each DAC 316 only has to process 384 channels of pixel data within a period of scanning time), the speed of the second line buffer 314B for outputting the pixel data PD and the processing speed of the DAC 316 may be one-eight of the speed of the first line buffer 314A for receiving the pixel data PD. That is, the operation frequency required by the DAC used in this invention may be eight times of the input frequency of the pixel data PD, and it is very easy to achieve the hardware requirement.

Figure 4:
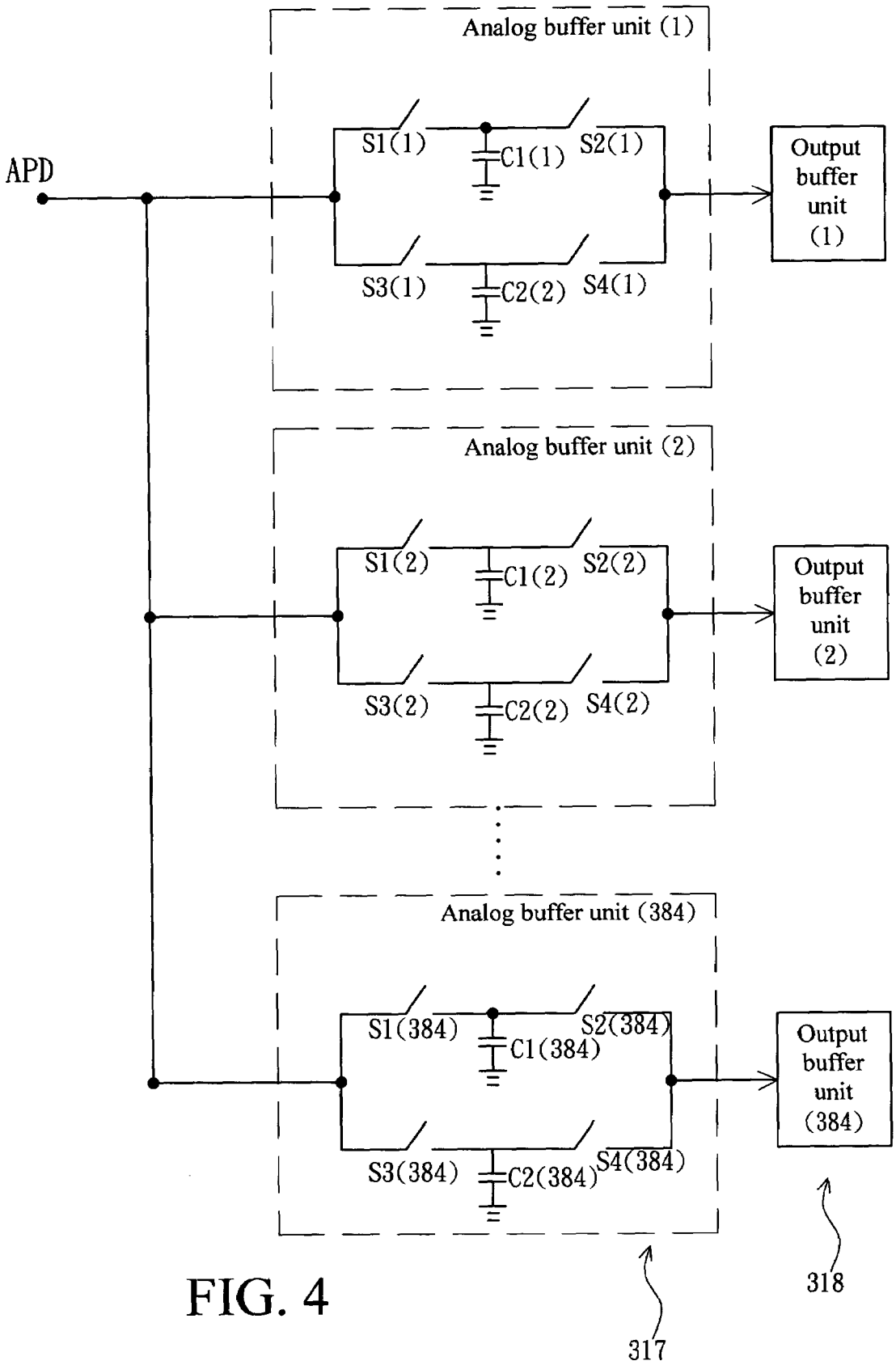
FIG. 4 is a circuit diagram showing internal details of the analog buffer in FIG. 3.

FIG. 4 is a circuit diagram showing internal details of the analog buffer in FIG. 3. Each analog buffer unit is implemented by a sample and hold circuit, and each sample and hold circuit is composed of switches S1, S2, S3, and S4, and capacitors C1 an C2. When 384 channels of analog pixel data APD in some row of pixels are received, the switches S1(1) to S1(384) turn on, which enables the analog pixel data APD to be sequentially stored in the capacitors C1(1) to C1(384). When 384 channels of analog pixel data APD in a next row of pixels are received, the switches S1(1) to S1(384) turn off while the switches S3(1) to S3(384) turn on, which enables 384 channels of analog pixel data APD of the next row of pixels to be stored in the capacitors C2(1) to C2(384). Meanwhile, the switches S2(1) to S2(384) turns on, which enables the 384 channels of analog pixel data APD stored in the capacitors C1(1) to C1(384) to be output to the output buffer units (1) to (384), respectively. When 384 channels of analog pixel data APD in a further next row of pixels are received, the switches S1(1) to S1(384) turn on while the switches S3(1) to S3(384) turns off, which enables the 384 channels of analog pixel data APD in the further next row of pixels to be stored in the capacitors C1(1) to C1(384). Meanwhile, the switches S4(1) to S4(384) turn on, which enables the 384 channels of analog pixel data APD stored in the capacitors C2(1) to C2(384) to be output to the output buffer units (1) to (384), respectively.

Figure 1:
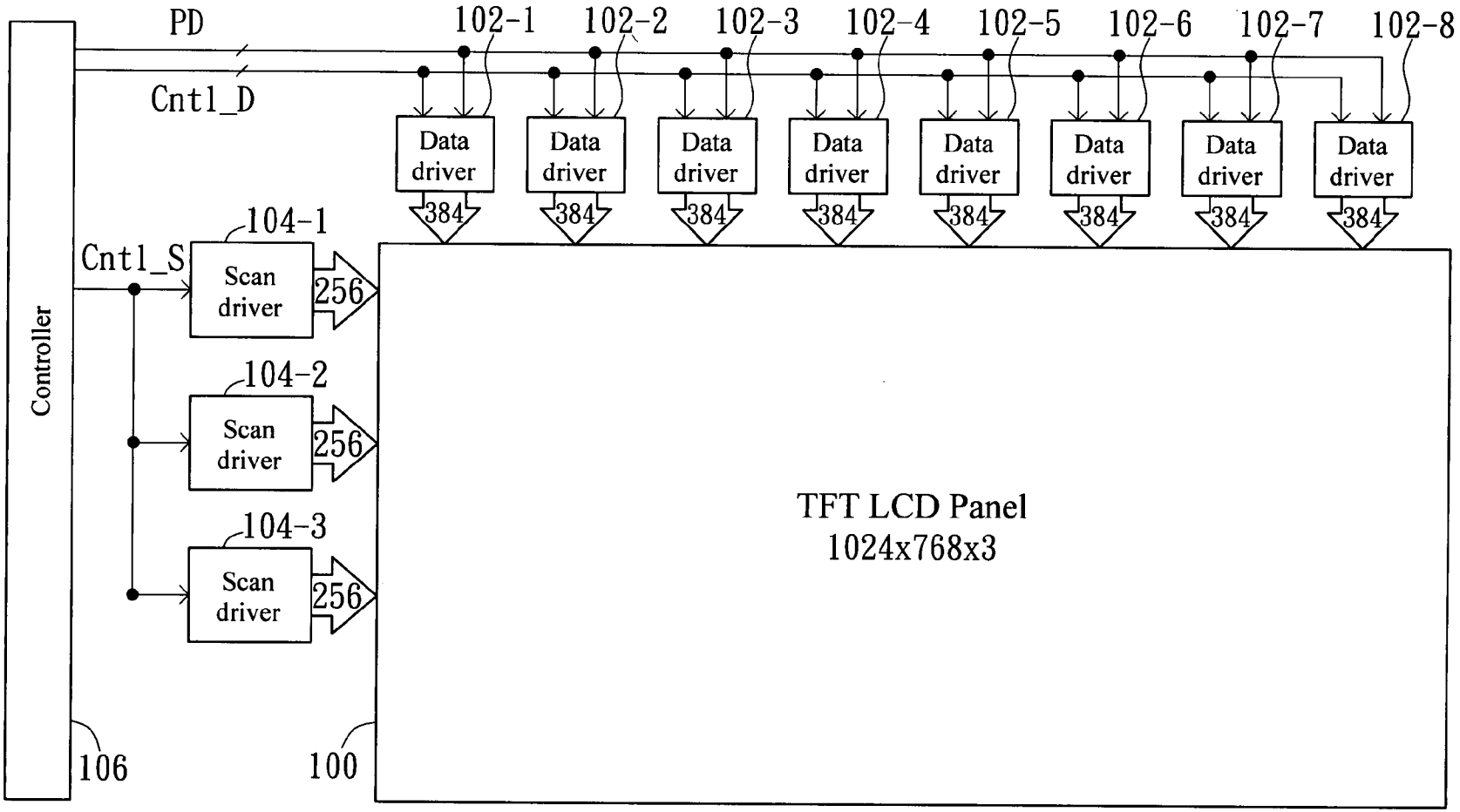
FIG. 1(PRIOR ART)
FIG. 1 is an architecture diagram showing a conventional LCD system.
Figure 2:
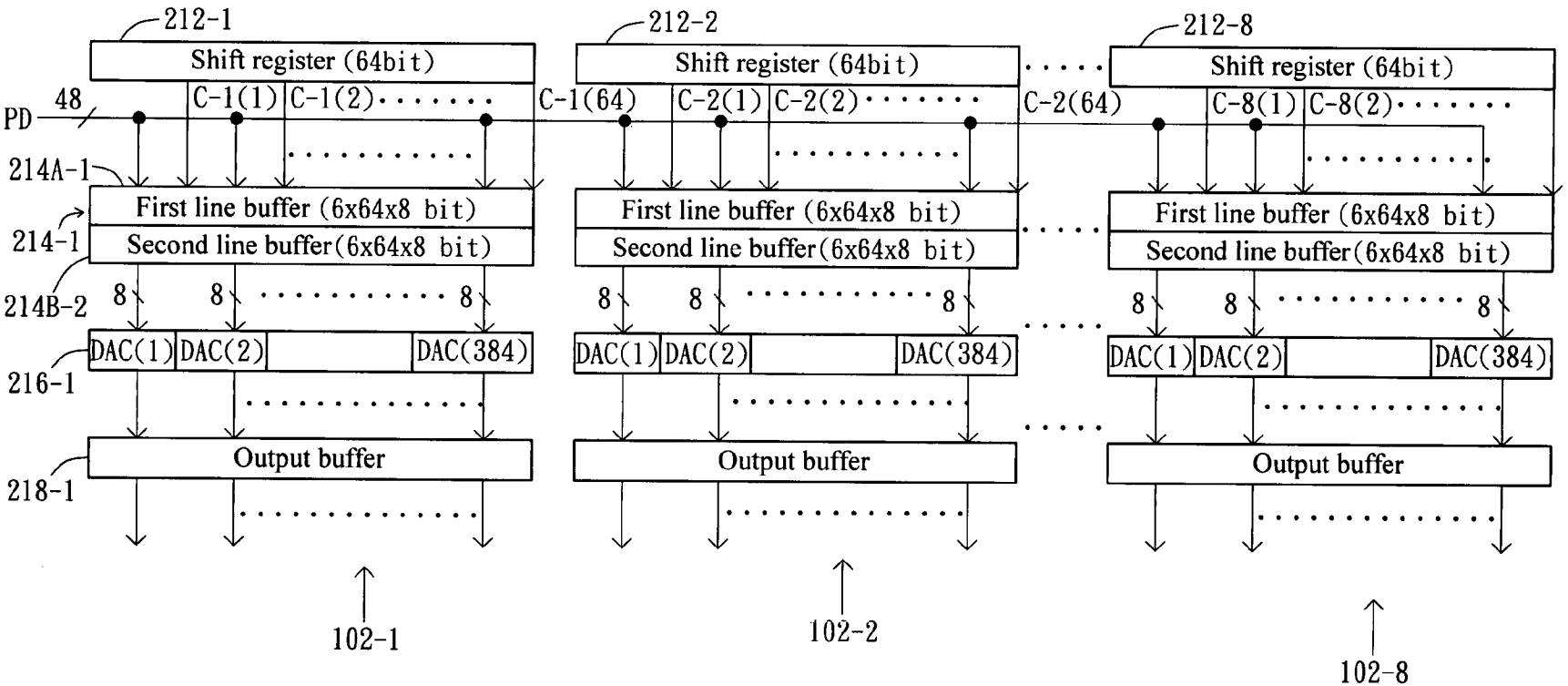
FIG. 2(PRIOR ART)
FIG. 2 is a circuit block diagram showing the data drivers 102-1 to 102-8 of FIG. 1.

Comparing the data driver 302 of this embodiment in FIG. 3 with the data driver 102 of FIG. 2 may obtain the following results. Since the digital-to-analog converting circuit 216 in the data driver 102 requires 384 DACs to convert 384 channels of digital pixel data PD into analog data and the data driver 302 of this embodiment only needs a DAC 316, the embodiment may advantageously save the chip area.

Figures 5, 5A, 5B:
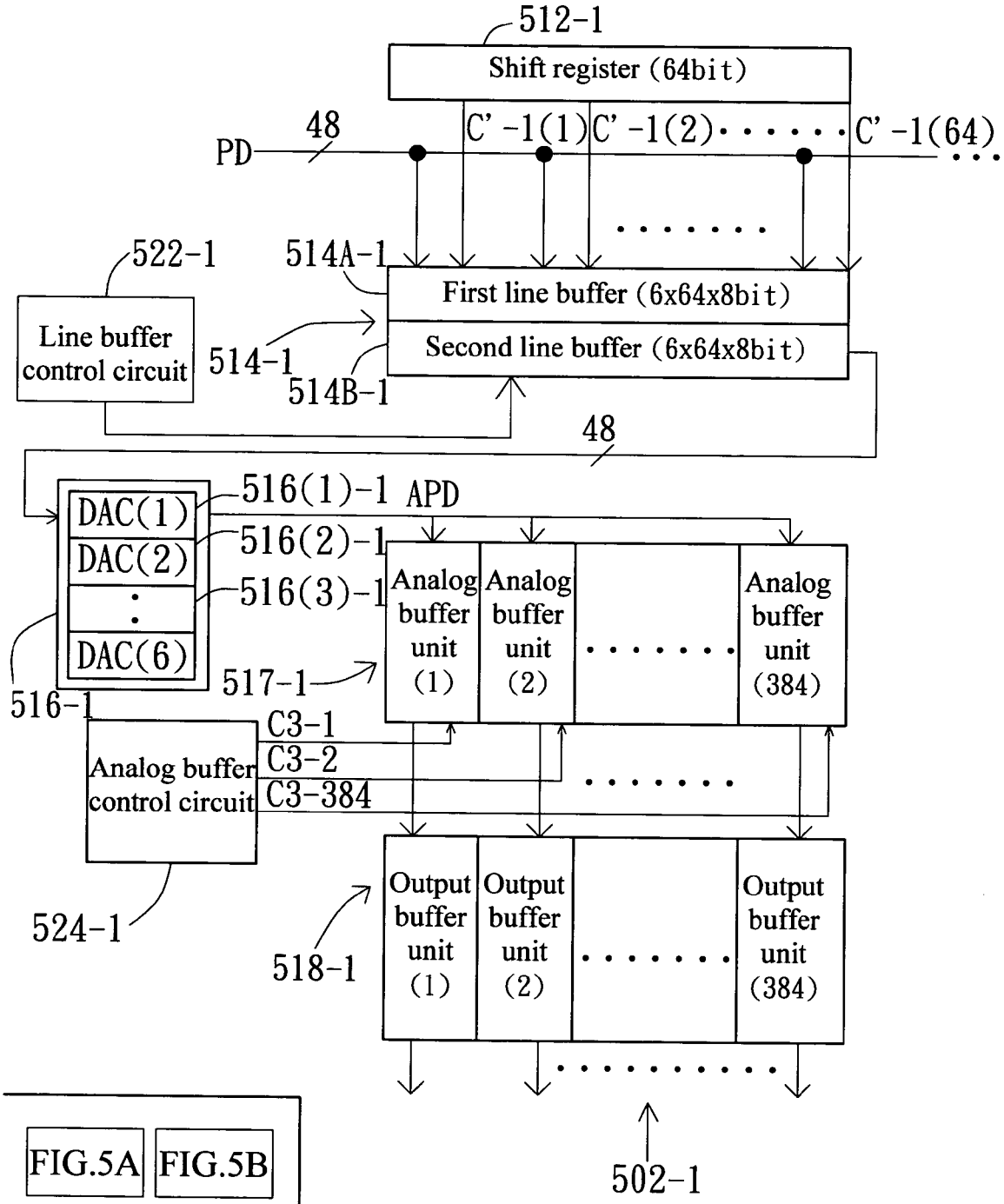
FIG. 5 is a circuit block diagram showing multiple data drivers according to a second embodiment of the invention.
Figure 5B:
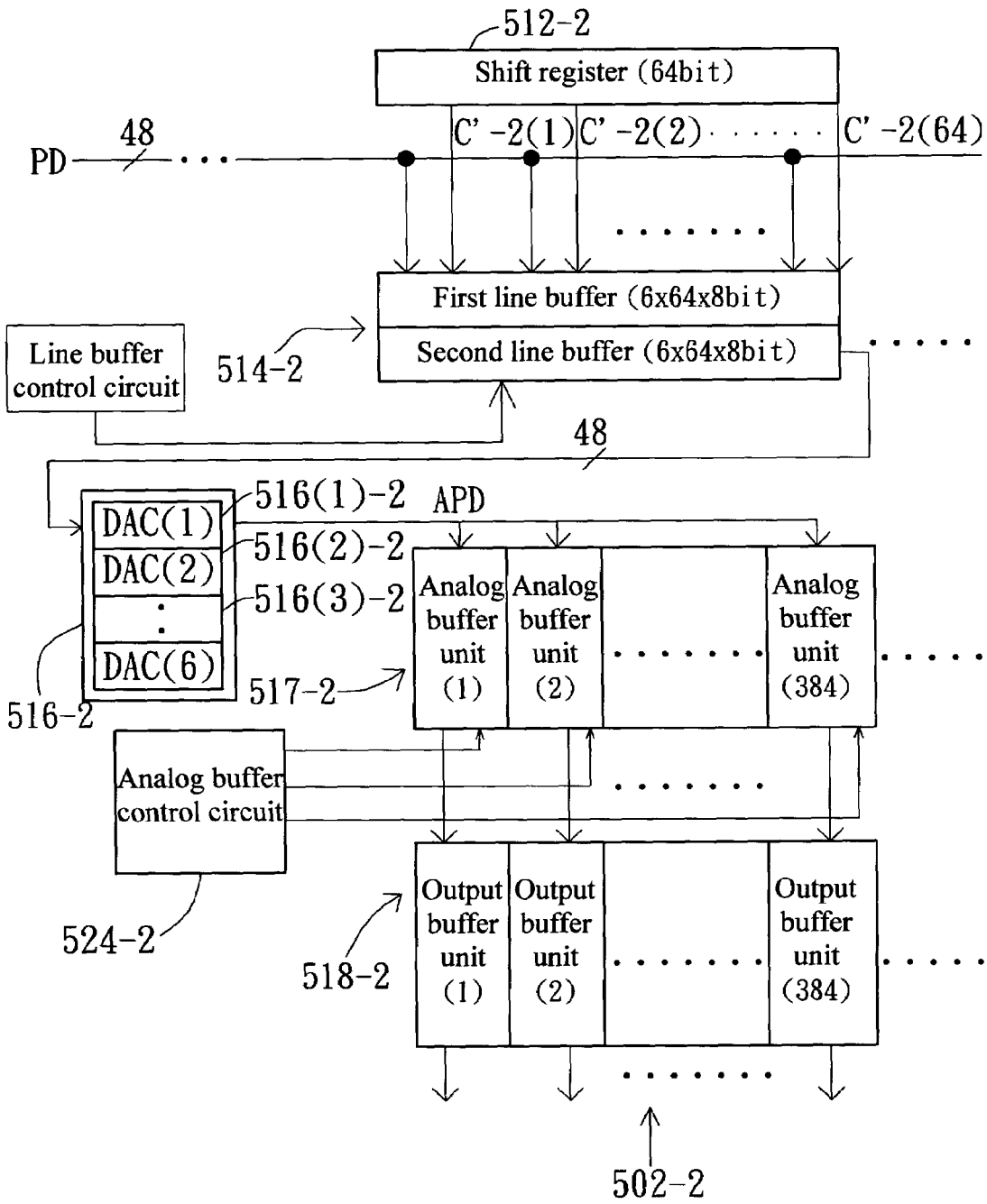

FIG. 5 is a circuit block diagram showing multiple data drivers according to a second embodiment of the invention. Each data driver 502 includes a shift register 512, a digital buffer 514, multiple DACs, an analog buffer 517, and an output buffer 518. The digital buffer 514 may be composed of a first line buffer 514A and a second line buffer 514B.

The difference between the second embodiment and the first embodiment of FIG. 3 resides in that the digital-to-analog converting circuit 516 used in the data driver 502 of the second embodiment is composed of multiple DACs, the number of which is smaller than 384 and may be, for example, 6. That is, the DACs include DACs 516(1) to 516(6). Consequently, six channels of pixel data PD may be output from the second line buffer 514B to the DACs 516(1) to 516(6) and converted from digital data to analog data simultaneously under the control of the line buffer control circuit 322. The six channels of converted analog pixel data APD may be simultaneously stored in six analog buffer units for further processing under the control of the analog buffer control circuit 324.

In the two above-mentioned embodiments, the capacities of the shift register and the line buffer of the data driver may be changed in different designs. The resolution of the LCD, the bit number of the pixel data transferred to the data driver at each time, and the channel number of the pixel data that is converted by the DAC at each time may also be adjusted according to the design requirements. Also, the digital buffer may be replaced by a buffer or memory that can selectively output data. Any modification that is made within the objective of selectively converting digital pixel data into analog data is intended to be within the range of the invention. Although the shift register, the line buffer control circuit, and the analog buffer control circuit are divided into different circuits in the examples, two or more than two circuits may be integrated into a specific control circuit.

The data driver disclosed in the above-mentioned embodiments of the invention has the following advantages. Since the number of DACs is greatly reduced as compared with the prior art, the invention may effectively reduce the chip area that is occupied by the DACs and thus the cost.

While the invention has been described by way of example and in terms of a preferred embodiment, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A data driver for driving a plurality of data lines on an LCD panel according to a plurality of channels of pixel data, the data driver comprising:

a digital buffer for receiving and storing the channels of the pixel data, and selectively outputting a channel of the pixel data per time;

a DAC (digital-to-analog converter) for sequentially converting the channels of the pixel data output from the digital buffer into a plurality of channels of analog pixel data and outputting a channel of the analog pixel data per time;

a plurality of analog buffer units, each analog buffer unit sequentially receiving and storing a channel of the analog pixel data output from the DAC, the analog buffer units outputting the channels of analog pixel data stored therein simultaneously; and an output buffer for receiving the channels of the analog pixel data output from the analog buffer units so as to drive the data lines.

2. The data driver according to claim 1, further comprising a shift register for commanding the digital buffer to receive the pixel data.

3. The data driver according to claim 1, wherein the digital buffer includes a first line buffer and a second line buffer; the first line buffer receives and stores the pixel data at several times; when the first line buffer finishes its receiving operations, the first line buffer parallely transfers all the pixel data stored therein to the second line buffer; and the second line buffer outputs a channel of the pixel data to the DAC at a time.

4. The data driver according to claim 3, further comprising a line buffer control circuit, and the second line buffer comprising multiple line buffer units, wherein the line buffer control circuit selects one of the line buffer units at a time, and the second line buffer outputs the pixel data stored in the selected line buffer unit.

5. A data driver for driving a plurality of data lines on an LCD panel according to a plurality of channels of pixel data, the data driver comprising:

a digital buffer for receiving and storing the channels of the pixel data, and selectively outputting N channels of the pixel data per time, wherein N is a positive integer greater than 1 and smaller than the number of the data lines;

N DACs (digital-to-analog converters) for converting the channels of the pixel data output from the digital buffer, into a plurality of channels of analog pixel data, and outputting N channels of the analog pixel data per time;

a plurality of analog buffer units, each analog buffer unit receiving and storing a channel of the analog pixel data respectively output from the N DACs, and the analog buffer units outputting the channels of the analog pixel data stored therein simultaneously; and an output buffer for receiving the channels of the analog pixel data output from the analog buffer units so as to drive the data lines.

6. The data driver according to claim 5, further comprising a shift register for commanding the digital buffer to receive the pixel data.

7. The data driver according to claim 6, wherein the digital buffer comprises a first line buffer and a second line buffer, the first line buffer receives and stores the pixel data at several times; when the first line buffer finishes its receiving operations, the first line buffer parallely transfers all the pixel data stored therein to the second line buffer; and the second line buffer selectively outputs N channels of the pixel data to the DACs at a time.

8. The data driver according to claim 7, further comprising a line buffer control circuit, and the second line buffer comprising multiple line buffer units, wherein the line buffer control circuit selects N line buffer units from the line buffer units at a time, and the second line buffer outputs the pixel data stored in the selected line buffer units.

9. A method for driving multiple data lines on an LCD panel according to a plurality of channels of pixel data, the method comprising:

receiving and storing in each of a plurality of digital buffer units pixel data for each of the plurality of channels;

successively converting, using a single digital-to-analog converter (DAC), pixel data from one of the channels at a time;

successively outputting the converted pixel data from the DAC to individual ones of a plurality of analog buffer units; and outputting, to drive the multiple data lines, the converted data from the plurality of analog buffer units, in a parallel fashion, after each channel of the pixel data has been converted and received by the plurality of analog buffer units.

* * * * *